US006223392B1

(12) United States Patent
Chang

(10) Patent No.: US 6,223,392 B1
(45) Date of Patent: May 1, 2001

(54) RETRACTABLE HANDLE ASSEMBLY

(76) Inventor: Wen-Chen Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/431,117

(22) Filed: Nov. 1, 1999

(51) Int. Cl.[7] ..... A45C 7/00
(52) U.S. Cl. ..... 16/113.1; 16/405; 280/655
(58) Field of Search ..... 16/113.1, 405, 16/429; 190/115, 18 A; 280/655, 655.1

(56) References Cited

U.S. PATENT DOCUMENTS 5,488,756 * 2/1996 Hsieh ..... 16/15
5,628,088 * 5/1997 Chen ..... 16/115
5,636,410 * 6/1997 Shou ..... 16/115
5,692,266 * 12/1997 Tsai ..... 16/115
5,704,725 * 1/1998 Horing ..... 403/109
6,128,806 * 10/2000 Sou-Mao ..... 16/113.1
6,141,828 * 11/2000 Kuo ..... 16/113.1
6,148,477 * 11/2000 Cheng ..... 16/113.1

* cited by examiner

*Primary Examiner*—Anthony Knight
*Assistant Examiner*—Mark Williams

(57) ABSTRACT

A retractable handle assembly has a grip device, a button, a U-shaped rod, a hollow driven rod, an inner pipe, an outer pipe, a seat, and a positioning mechanism. The seat has two sleeves and two oblong holes. The grip device has a first grip casing and a second grip casing. An upper end of the hollow driven rod receives an end portion of the U-shaped rod. The hollow driven rod is inserted in the inner pipe. The inner pipe is inserted in the outer pipe. An upper end of the inner pipe is inserted in a lower groove of the first grip casing. An upper end of the outer pipe is inserted in a sleeve of the seat. The positioning mechanism is disposed on a bottom of the inner pipe.

1 Claim, 3 Drawing Sheets

RETRACTABLE HANDLE ASSEMBLY

BACKGROUND OF THE INVENTION

The present invention relates to a retractable handle assembly. More particularly, the present invention relates to a retractable handle assembly for a suitcase.

A conventional handle device of a suitcase can be extended or retracted according to the operation of the user. The conventional handle device is inserted in the suitcase. However, a retractable mechanism of the conventional handle device may be broken easily. U.S. Pat. No. 5,500,981 has disclosed a handle device of a suitcase.

SUMMARY OF THE INVENTION

An object of the present invention is to provide a retractable handle assembly which can be operated easily.

Another object of the present invention is to provide a retractable handle assembly which will not be broken after a long period of usage.

Accordingly, a retractable handle assembly comprises a grip device, a button, a U-shaped rod, a hollow driven rod, an inner pipe, an outer pipe, a seat, and a positioning mechanism. The seat has two sleeves and two oblong holes. The button encloses a center portion of the U-shaped rod. The grip device has a first grip casing and a second grip casing engaging with the first grip casing. The first grip casing has an upper recess, two lower grooves, and a hollow interior receiving the button, a coiled spring, and the U-shaped rod. The coiled spring is disposed on a bottom of the button. The second grip casing has an upper groove and two circular holes. The U-shaped rod has two end portions. An upper end of the hollow driven rod receives the respective end portion of the U-shaped rod. A round hole is formed on an upper portion of the inner pipe. A plurality of oblong apertures are formed on the outer pipe. The hollow driven rod is inserted in the inner pipe. The inner pipe is inserted in the outer pipe. An upper end of the inner pipe is inserted in the respective lower groove of the first grip casing. The inner pipe passes through the respective oblong hole of the seat. An upper end of the outer pipe is inserted in the respective sleeve. The positioning mechanism is disposed on a bottom of the inner pipe. The positioning mechanism has a mount, a lateral plate engaging with the mount, a hollow brake block, and a positioning block. The mount has a guide groove and a positioning groove. The hollow brake block has a bevel groove. The positioning block has two posts. The hollow brake block is inserted in the guide groove of the mount. A compression spring is disposed on a bottom of the hollow brake block. The positioning block is inserted in the positioning groove of the mount. The posts are inserted in the bevel groove of the hollow brake block. When the button is released, the coiled spring forces the button to move upward and the compression spring forces the hollow brake block to move upward. The positioning block is inserted in one of the oblong apertures of the outer pipe. When the button is pressed downward, the hollow driven rod drives the hollow brake block to move downward. The posts move upward along the bevel groove of the hollow brake block so that the positioning block will disengage from the respective oblong aperture of the outer pipe.

DETAILED DESCRIPTION OF THE INVENTION

Figure 1:
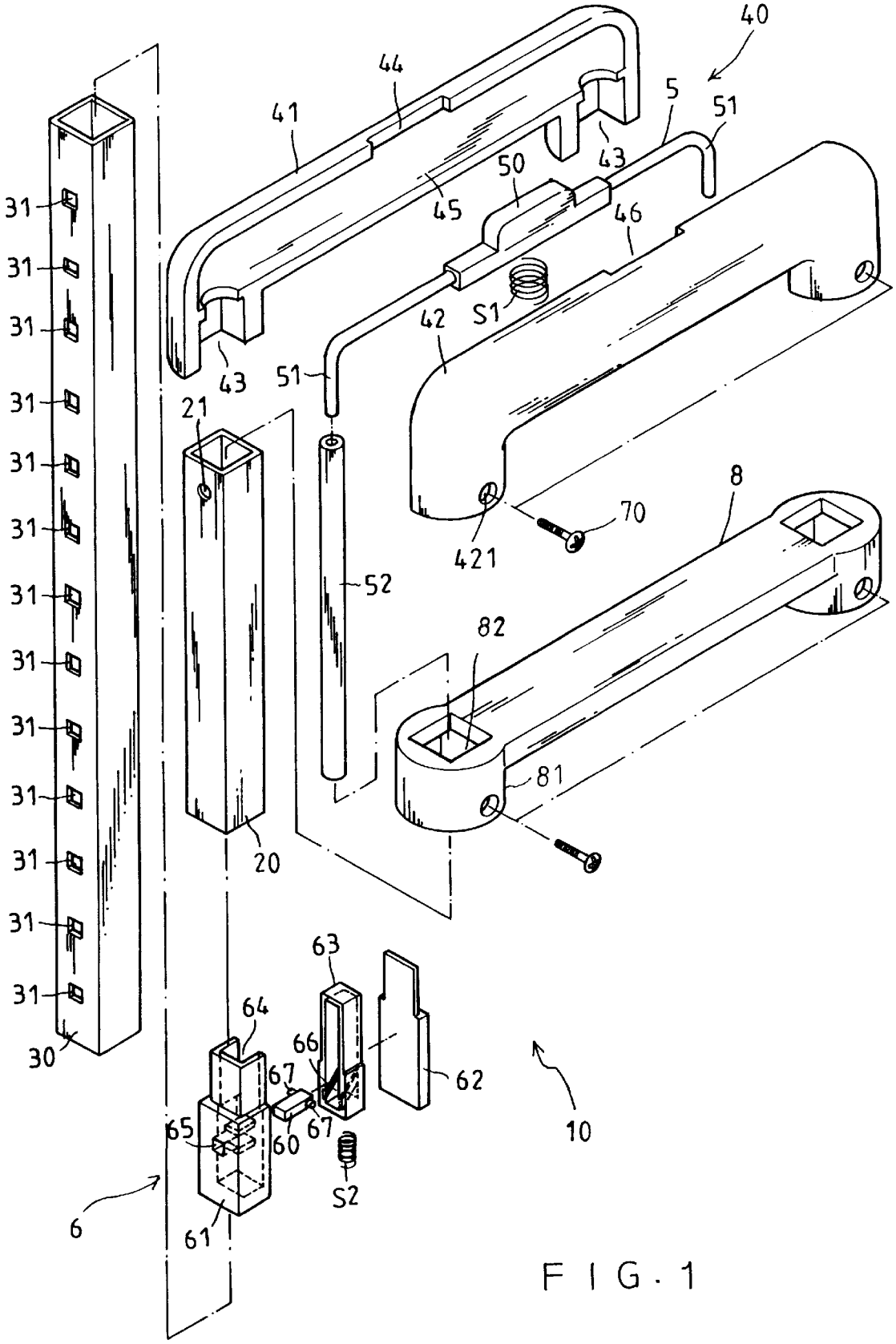
FIG. 1 is a perspective exploded view of a retractable handle assembly of a preferred embodiment in accordance with the present invention.
Figure 2:
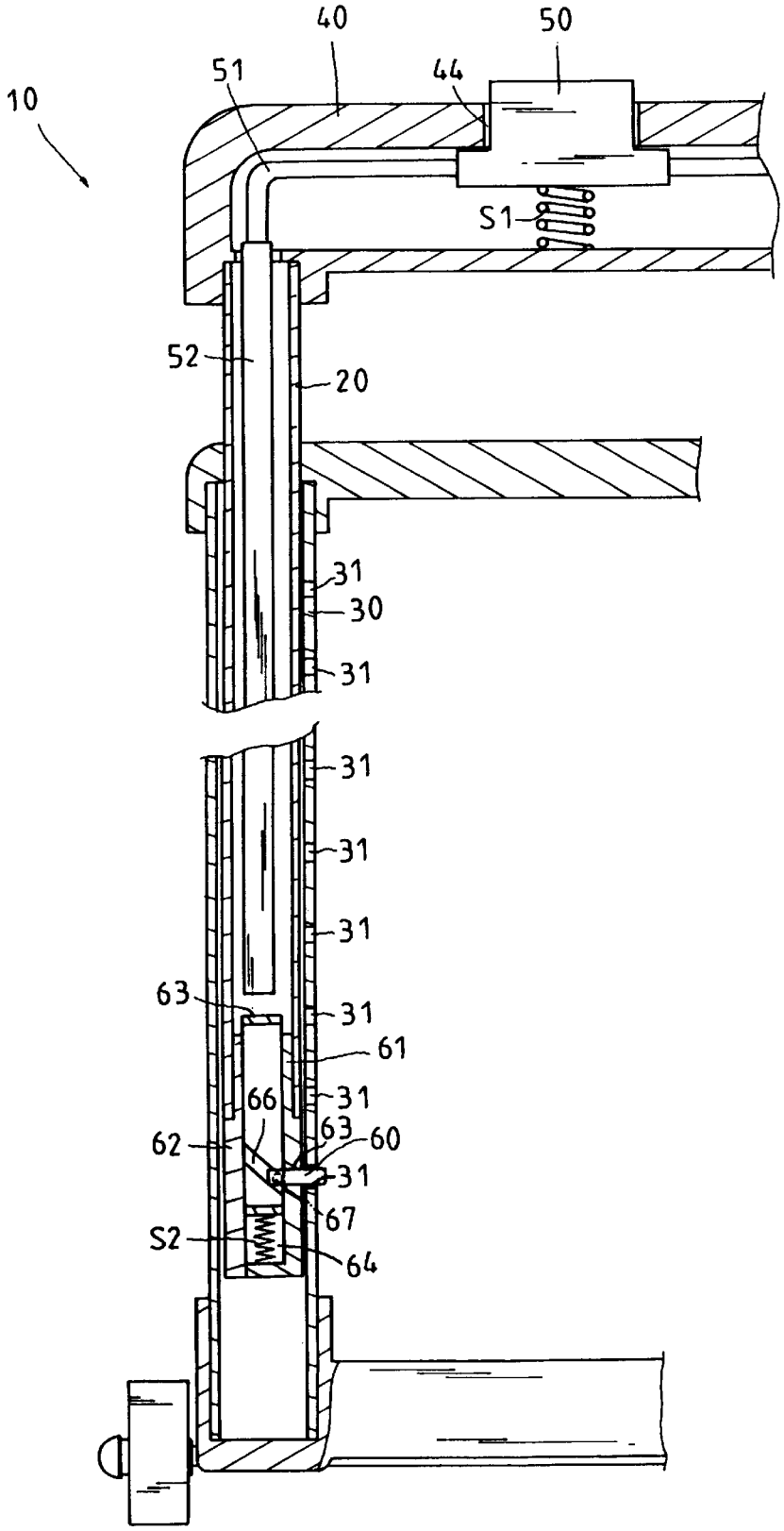
FIG. 2 is a sectional assembly view of a retractable handle assembly of a preferred embodiment in accordance with the present invention.
Figure 3:
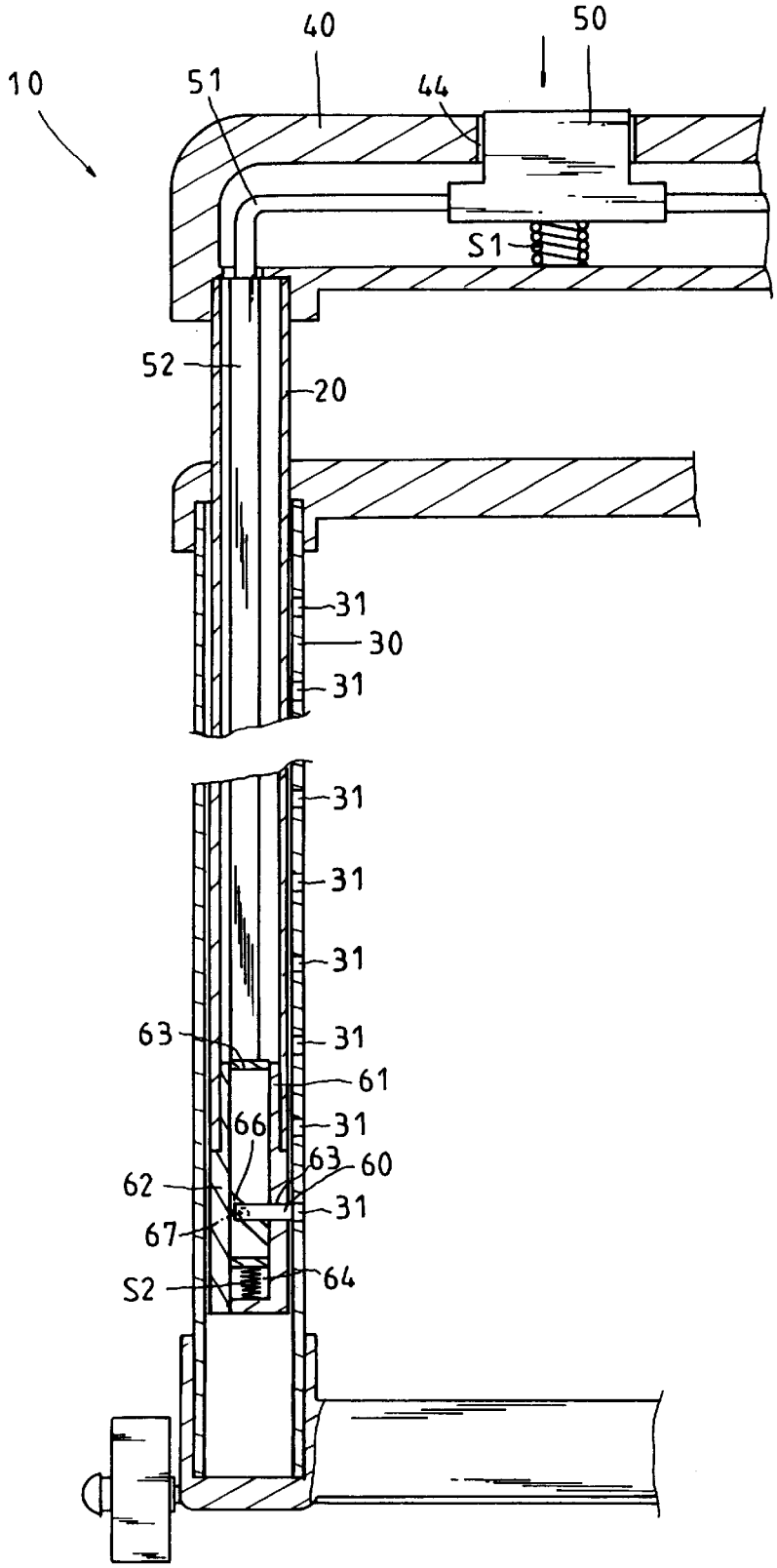
FIG. 3 is a schematic view illustrating an operation of a retractable handle assembly of a preferred embodiment.

Referring to FIGS. 1 to 3, a retractable handle assembly 10 comprises a grip device 40, a button 50, a U-shaped rod 5, a hollow driven rod 52, an inner pipe 20, an outer pipe 30, a seat 8, and a positioning mechanism 6. The seat 8 has two sleeves 81 and two oblong holes 82.

The button 50 encloses a center portion of the U-shaped rod 5.

The grip device 40 has a first grip casing 41 and a second grip casing 42 engaging with the first grip casing 41.

The first grip casing 41 has an upper recess 44, two lower grooves 43, and a hollow interior 44 receiving the button 50, a coiled spring S1, and the U-shaped rod 5.

The coiled spring S1 is disposed on a bottom of the button 50.

The second grip casing 42 has an upper groove 46 and two circular holes 421.

The U-shaped rod 5 has two end portions 51. An upper end of the hollow driven rod 52 receives the respective end portion 51 of the U-shaped rod 5.

A round hole 21 is formed on an upper portion of the inner pipe 20.

A plurality of oblong apertures 31 are formed on the outer pipe 30.

The hollow driven rod 52 is inserted in the inner pipe 20. The inner pipe 20 is inserted in the outer pipe 30.

An upper end of the inner pipe 20 is inserted in the respective lower groove 43 of the first grip casing 41.

The inner pipe 20 passes through the respective oblong hole 82 of the seat 8.

An upper end of the outer pipe 30 is inserted in the respective sleeve 81.

The positioning mechanism 6 is disposed on a bottom of the inner pipe 20.

The positioning mechanism 6 has a mount 61, a lateral plate 62 engaging with the mount 61, a hollow brake block 63, and a positioning block 60.

The mount 61 has a guide groove 64 and a positioning groove 65. The hollow brake block 63 has a bevel groove 66. The positioning block 60 has two posts 67.

The hollow brake block 63 is inserted in the guide groove 64 of the mount 61. A compression spring S2 is disposed on a bottom of the hollow brake block 63.

The positioning block 60 is inserted in the positioning groove 65 of the mount 61.

The posts 67 are inserted in the bevel groove 66 of the hollow brake block 63.

A rivet 421 fastens the second grip casing 42 and the inner pipe 20 together via the respective circular hole 421 and the round hole 21.

When the button 50 is released, the coiled spring S1 forces the button 50 to move upward and the compression spring S2 forces the hollow brake block 63 to move upward. The positioning block 60 is inserted in one of the oblong apertures 31 of the outer pipe 30.

When the button 50 is pressed downward, the hollow driven rod 52 drives the hollow brake block 63 to move downward. The posts 67 move upward along the bevel groove 66 of the hollow brake block 63 so that the positioning block 60 will disengage from the respective oblong aperture 31 of the outer pipe 30.

The present invention is not limited to the above embodiment but various modification thereof may be made. Furthermore, various changes in form and detail may be made without departing from the scope of the present invention.

I claim:

1. A retractable handle assembly comprises:

a grip device, a button, a U-shaped rod, a hollow driven rod, an inner pipe, an outer pipe, a seat, and a positioning mechanism, the seat having two sleeves and two oblong holes, the button enclosing a center portion of the U-shaped rod, the grip device having a first grip casing and a second grip casing engaging with the first grip casing, the first grip casing having an upper recess, two lower grooves, and a hollow interior receiving the button, a coiled spring, and the U-shaped rod, the coiled spring disposed on a bottom of the button, the second grip casing having an upper groove and two circular holes, the U-shaped rod having two end portions, an upper end of the hollow driven rod receiving the respective end portion of the U-shaped rod, a round hole formed on an upper portion of the inner pipe, a plurality of oblong apertures formed on the outer pipe, the hollow driven rod inserted in the inner pipe, the inner pipe inserted in the outer pipe, an upper end of the inner pipe inserted in the respective lower groove of the first grip casing, the inner pipe passing through the respective oblong hole of the seat, an upper end of the outer pipe inserted in the respective sleeve, the positioning mechanism disposed on a bottom of the inner pipe, the positioning mechanism having a mount, a lateral plate engaging with the mount, a hollow brake block, and a positioning block, the mount having a guide groove and a positioning groove, the hollow brake block having a bevel groove, the positioning block having two posts, the hollow brake block inserted in the guide groove of the mount, a compression spring disposed on a bottom of the hollow brake block, the positioning block inserted in the positioning groove of the mount, the posts inserted in the bevel groove of the hollow brake block, when the button is released, the coiled spring forces the button to move upward, the compression spring forces the hollow brake block to move upward, and the positioning block is inserted in one of the oblong apertures of the outer pipe, when the button is pressed downward, the hollow driven rod drives the hollow brake block to move downward, and the posts move upward along the bevel groove of the hollow brake block so that the positioning block will disengage from the respective oblong aperture of the outer pipe.

* * * * *